US007458178B2

(12) United States Patent
Paschall

(10) Patent No.: US 7,458,178 B2
(45) Date of Patent: Dec. 2, 2008

(54) PAPER CURRENCY AND MEMORABILIA PRESENTATION AND DISPLAY CASE

(76) Inventor: Michael Paschall, HHD, 38th PSB, CMR 449 Box 1747, APO AE 09031 (DE)

( * ) Notice: Subject to any disclaimer, the term of this patent is extended or adjusted under 35 U.S.C. 154(b) by 0 days.

(21) Appl. No.: 10/186,582

(22) Filed: Jul. 1, 2002

(65) Prior Publication Data

US 2004/0000081 A1 Jan. 1, 2004

(51) Int. Cl.
*G09F 3/18* (2006.01)

(52) U.S. Cl. ..... 40/661; 206/449

(58) Field of Classification Search ..... 40/642.02, 40/661, 323, 771, 781, 649, 709; 428/13; 206/0.8, 0.82, 39, 449, 485, 485.1; 292/307 R, 292/307 A, 307 B; 220/4.24, 4.25; 150/132, 150/145, 147, 150; D3/250, 251
See application file for complete search history.

(56) References Cited

U.S. PATENT DOCUMENTS 1,863,001 A * 6/1932 Barok et al. ..... 220/4.07
2,378,774 A * 6/1945 Husted ..... 206/259
2,451,913 A * 10/1948 Brice ..... 428/67
3,620,403 A * 11/1971 Rump ..... 220/4.24
4,512,471 A * 4/1985 Kaster et al. ..... 206/438
4,524,867 A * 6/1985 Klein et al. ..... 206/232
4,592,465 A * 6/1986 Stein ..... 206/0.83
4,884,684 A * 12/1989 Bernardin et al. ..... 206/204
5,165,538 A * 11/1992 Peters ..... 206/315.9
5,411,140 A * 5/1995 Byer ..... 206/504
5,503,274 A * 4/1996 Toffler et al. ..... 206/457
5,507,492 A * 4/1996 Adell ..... 273/144 B
6,029,807 A * 2/2000 Love ..... 206/0.82

* cited by examiner

*Primary Examiner*—Joanne Silbermann

(57) ABSTRACT

A presentation display case for storing, displaying or preserving paper currency or valued memorabilia. The case is formed as a transparent, durable display case for sealing and preserving paper currency and memorabilia e.g. items that will be of monetary value when redeemed which can be displayed in trophy fashion in a casing that can stand on its base without the need for a stand.

6 Claims, 2 Drawing Sheets

WHENEVER YOU GO BROKE
BREAK ME!
MAKE BANK
SPARE BOX
1
11
15
17
19
10
6
9
13
5
7
3
4

PAPER CURRENCY AND MEMORABILIA PRESENTATION AND DISPLAY CASE

BACKGROUND OF THE INVENTION

1. Field of the Invention

The present invention relates to a presentation display case for storing, displaying or preserving paper currency or valued memorabilia. In particular the present invention provides for a transparent, durable display case for sealing and preserving paper currency and memorabilia e.g. items that will be of monetary value when redeemed which can be displayed in trophy fashion in a casing that can stand on its base without the need for a stand.

2. The Related Prior Art

U.S. Pat. No. 5,477,631 relates to an expandable display device and sports card holder which permits the user to remove cards from the casing whenever he or she chooses. It does not disclose sealing a unique paper currency or memorabilia in a case until the seal is broken for removal of the sealed contents.

U.S. Pat. No. 3,155,236 relates to a coin holder and exhibitor. It does not disclose a casing for housing paper currency.

Accordingly it would be desirable to provide a case for housing a paper currency or a memorabilia item therein for display, which can be scaled until the seal is broken and the memorabilia or paper currency item is removed.

SUMMARY OF THE INVENTION

The present invention provides a case for displaying memorabilia or paper currency. The case is at least substantially transparent and is formed of two portions that are joined together to preferably form a rectangular housing. Each portion has a side surface with a slit extending horizontally through each of the portions of the case so that a paper currency item or a memorabilia can be placed through the slit and into each portion of the case. Thus when the two portions are pushed together the side surfaces abut each portion and the paper currency or memorabilia item is displayed in its entirety within the case. The adhesive seal can then be wrapped around the periphery of the part of the case where two portions meet to seal the case.

Other objects of the present invention will become readily apparent from the forgoing description and accompanying drawings.

DETAILED DESCRIPTION OF THE PREFERRED EMBODIMENTS

Figures 1, 2:
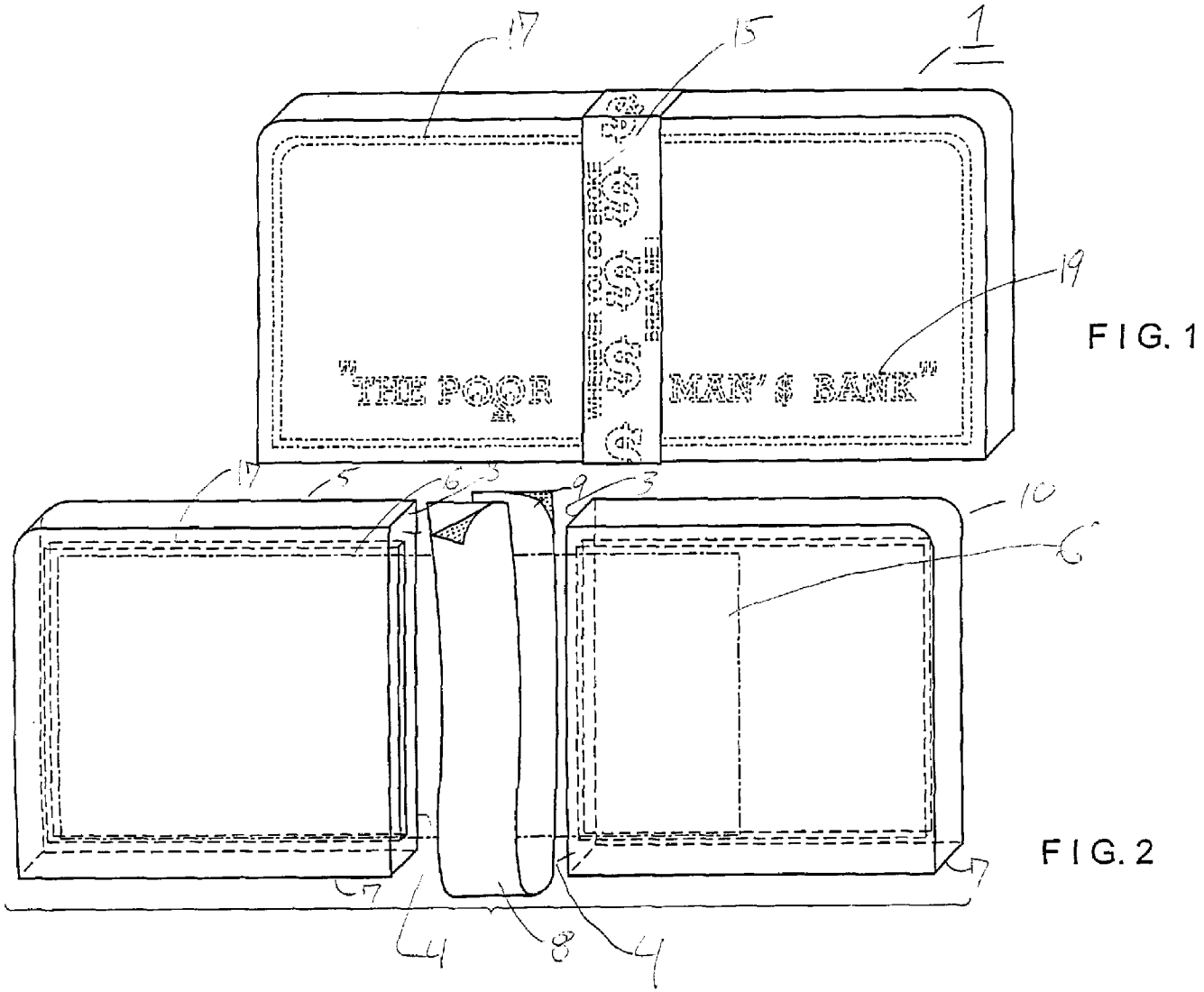
FIG. 1 is a front perspective view of the present invention in its sealed state.
FIG. 2 is a front perspective view of the present invention in its unsealed state.

Referring now to the drawings of FIGS. 1-5, FIG. 1 shows the present invention in its sealed state.

The invention is a display case having a housing 1 formed of two portions 5 and 10 that are preferably substantially equal in size (see FIG. 2). The housing 1 is preferably rectanguarly shaped as shown in FIGS. 1 and 2 with a base 7 on which the housing can stand. FIG. 2 shows the housing in its unsealed state. Each portion of the housing 1 has a side surface 3 containing a recess or slit 4 through which a portion of a paper currency item or a memorabilia item 6 (shown in dashed lines in FIG. 2) can be inserted as shown in FIG. 2

Figure 3:
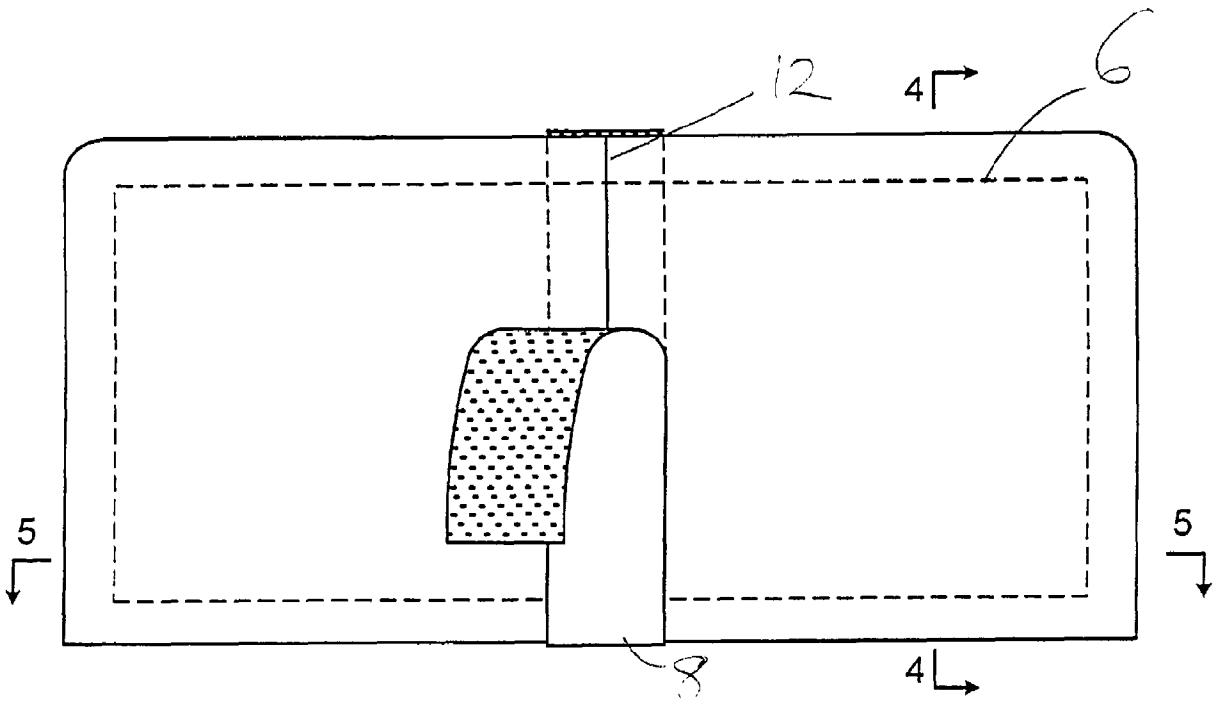
FIG. 3 is a rear view of the present invention showing the housing being sealed.

An adhesive strip 8 with a removable paper backing 9 which when removed exposes the adhesive surface can then be wrapped around the housing at the location where the two portions of the housing abut when the paper currency or memorabilia item is fully inserted inside the recesses of both portions and the portions are pushed toward each other as shown in FIGS. 2 and 3.

Figure 4:
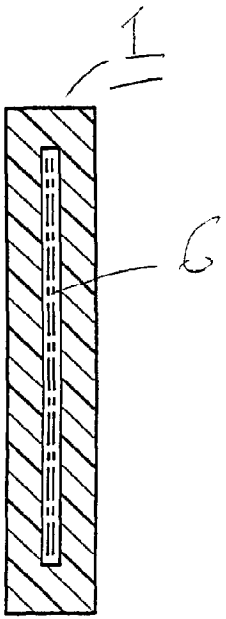
FIG. 4 is a sectional view along lines 4-4 of FIG. 3.

FIG. 4 is a sectional view of FIG. 3 showing the housing 1 in its sealed state from a side view where the paper currency 6 can be seen contained sealingly within the housing 1.

Figure 5:
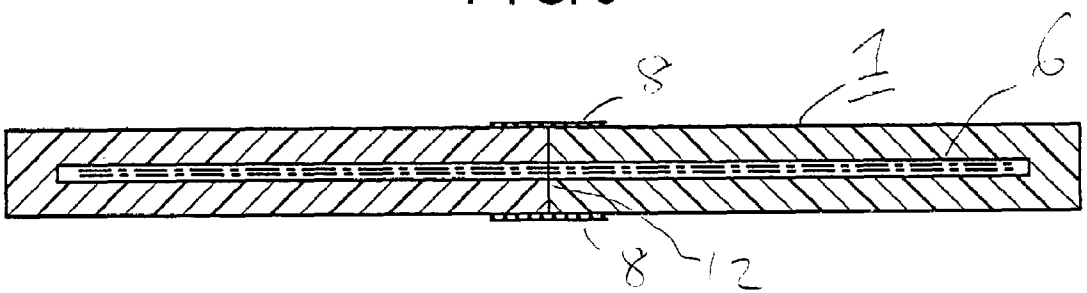
FIG. 5 is a sectional view of FIG. 3 along lines 5-5.

Similarly, FIG. 5 is a bottom sectional view of FIG. 3 showing the paper currency or memorabilia 6 in the sealed housing land showing that the adhesive strip or label 8 sealing the housing 1 extends along the front and rear of the housing 1.

The housing 1 is at least substantially transparent so that the paper currency or memorabilia item 6 can be viewed within the display case.

The adhesive strip or label 8 preferably contains at least one and possibly more distinct messages 15 on it. Two illustrative distinct messages on the adhesive strip are: 1. "WHENEVER YOU GO BROKE BREAK ME" 15 (front side of housing) and 2. "BETTER ME BROKE THAN YOU" (rear side of the housing).

The two portions 5, 10 forming the housing 1 each have a hollowed out slot or opening 4 at an end surface 4 that extends inside each of the portions 5, 10 horizontally so that when the two portions 5, 10 are joined together they form a slotted transparent rectangular frame with an inner compartment where the paper currency item or memorabilia item 8 will be housed and displayed. There are no other openings in the housing 1. The display case when sealed with the adhesive label or strip 8 stands on its base 7 without the need for support by an additional base. This display case of the present invention can be manufactured in a variation of sizes to accommodate all types of sized currency and valued memorabilia, such as certificates and awards. The housing can be decorated with graphic designs and text as is appropriate such as "THEPOOR MAN'$ BANK" 19 as shown in FIG. 1.

A person would load the paper currency or memorabilia item as follows:

1. Place the two clear housing portions 5, 10 front side up as shown in FIG. 1 this would be with the wording "THE POOR" on the left side and the portion with the wording "MAN'$ BANK" on the right side so that the two side surfaces 3 with the recess openings 4 facing each other.

2. Slide one half of the paper currency or memorabilia 6 one wishes to load into one of the two portions' recesses 4.

3. Slide the other portion of the housing onto the exposed portion of the paper currency or memorabilia 6 so that the exposed portion enters into the recess 4 of this other portion of the housing 1.

4. Slide the two portions 5, 10 of the housing 1 together so that they abut against each other flush. Ensure that the printed borders 17 (which can be preferably printed green) on the front surface of the housing 1 as shown in FIG. 1 are lined up before sealing the housing.

5. Tear off the paper backing 9 of the adhesive strip or label preferably displaying the two distinct messages While holding the label at both ends, with the adhesive side facing down ward center the first message e.g. "WHENEVER YOU GO BROKEBREAK ME" in the middle of the housing and align the illustrated dollar signs on the label along the line or juncture line 12 (see FIGS. 3 and 5) where the two portions of the housing meet.

6. Once the message, the borderlines 17 on the housing 1 and the dollar signs on the label are lined up correctly, lower the label down onto the front sign of the housing 1. Rub the adhesive label 8 lightly to seal it in place.

7. Turn the housing 1 over continue to seal the adhesive label 8 to the bottom, top and rear surfaces of the housing. The second illustrated message on the adhesive label "BETTER ME BROKE THAN YOU" will automatically line up on the reverse side once the label is completely sealed around the housing 1.

8. Tap the sides of the housing 1 lightly to center the document, e.g. paper currency or memorabilia item 6 once it has been sealed inside the housing 1.

While presently preferred embodiments have been described for purposes of the disclosure, it is understood that numerous changes in the arrangement of apparatus parts can be made by those skilled in the art. Such changes are encompassed within the spirit of the invention as defined by the appended claims.

The invention claimed is:

1. In combination, a paper currency presentation and display case comprising:

a paper currency, a substantially transparent housing, having a front surface and a rear surface, said front surface and said rear surface of said housing being spaced apart from each other within said housing by a slit, therein to receive and accommodate said paper currency therein so that a front surface and rear surface of said paper currency being can be displayed through said front and rear surfaces of said housing, respectively, formed of two portions adapted to be joined together, each of said two portions having a side surface wherein each said side surface of each said portion faces each other, each of said side facing surfaces having said slit therein, wherein said each of said slits being sufficiently wide to accommodate a width of said paper currency and to receive and house a portion of said paper currency within a respective one of said two slits therein so that when said side faces are abutting each other said paper currency is entirely housed within said slit of said housing for displaying aid front surface and said rear surface of said paper currency through the front and rear surfaces of said housing: said side faces of said two portions are placed together in flush contact with each other and are sealed, thereby sealing said two portions together, by sealing means placed around said case, said case is formed of plastic material and is substantially rectangular shaped with a base on which the housing can stand upright.

2. The case according to claim 1 wherein said slit in each portion extends horizontally within each of said two portions so as to be adapted to receive and house a portion of said paper currency therein.

3. The case according to claim 1 wherein said sealing means is an adhesive strip placed around the case where said two portions meet to abut against each other.

4. The case according to claim 3 wherein said adhesive strip includes indicia thereon.

5. The case according to claim 4 wherein said indicia includes two distinctive statements of each said two distinct statements to be located on the front surface of said housing and another one of said two distinct statements to be located on the rear of said housing respectively.

6. The case according to claim 1 wherein said housing includes decorative designs and text.

* * * * *